US005317133A

United States Patent [19]

Sundström et al.

[11] Patent Number: 5,317,133

[45] Date of Patent: May 31, 1994

[54] METHOD FOR CONTROLLING THE MICROWAVE ENERGY IN A MICROWAVE OVEN, AND MICROWAVE OVEN FOR IMPLEMENTING THE METHOD

[75] Inventors: Tim Sundström; David Wahlander, both of Norrköping, Sweden

[73] Assignee: Whirlpool Europe B.V., Veldhoven, Netherlands

[21] Appl. No.: 40,242

[22] Filed: Mar. 30, 1993

[30] Foreign Application Priority Data

Apr. 3, 1992 [SE] Sweden ..... 9201071A

[51] Int. Cl.[5] ..... H05B 6/68

[52] U.S. Cl. ..... 219/716; 219/718; 219/719; 219/710

[58] Field of Search ..... 219/10.55 B, 10.55 E, 219/10.55 M, 497, 716, 718, 715, 710, 719

[56] References Cited

U.S. PATENT DOCUMENTS

| | | | |
|---|---|---|---|
| 4,900,885 | 2/1990 | Inumada | 219/10.55 B |
| 4,931,609 | 6/1990 | Aoki | 219/10.55 B |
| 4,990,733 | 2/1991 | Joelsson et al. | 219/10.55 B |
| 4,992,637 | 2/1991 | Ishiyama | 219/10.55 B |
| 5,003,141 | 3/1991 | Braunisch et al. | 219/10.55 B |
| 5,208,432 | 5/1993 | Han | 219/10.55 B |
| 5,212,360 | 5/1993 | Carlson | 219/10.55 B |

*Primary Examiner*—Philip H. Leung
*Attorney, Agent, or Firm*—Robert O. Rice; Thomas J. Roth; Stephen D. Krefman

[57] ABSTRACT

A microwave oven having a pulsed magnetron comprises a timing circuit which determines a cooking time and the pulse duration when the magnetron is pulsed. By means of a time and power setting device, the cooking time and the pulse duration are adapted to a food introduced into the oven chamber. At least one operation parameter affecting the magnetron output is measured and compared with the nominal value of the parameter. In the event of a difference between the measured and the nominal parameter value, the cooking time and/or the pulse duration is/are corrected in relation to the set values in order to eliminate the effect of this difference on the total quantity of energy supplied during cooking.

13 Claims, 2 Drawing Sheets

Figure 5:
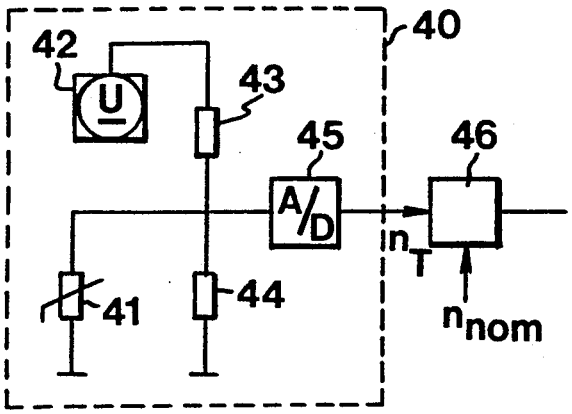

FIG.1
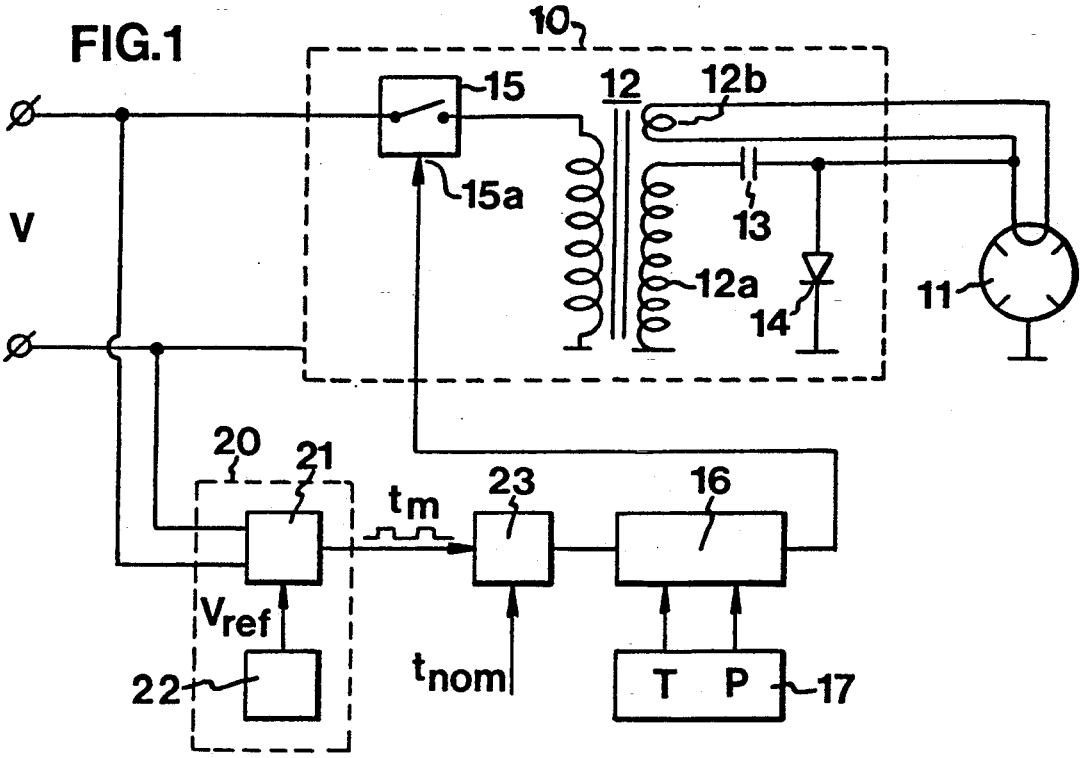
FIG.2
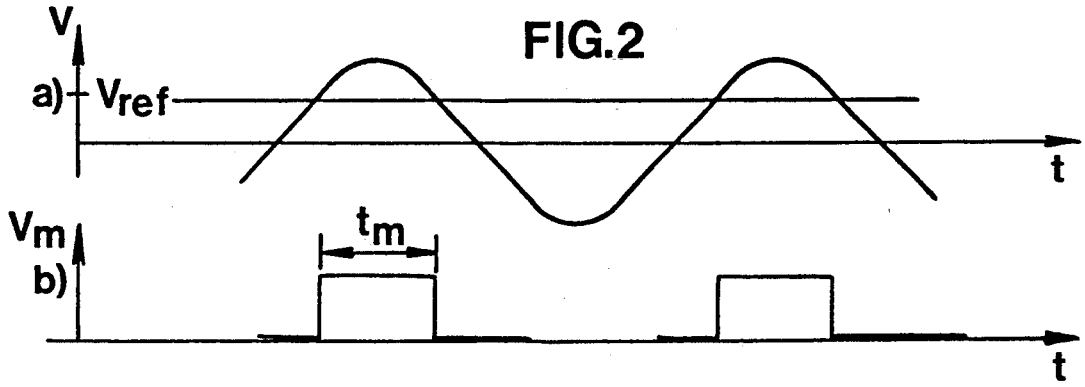
FIG.3
| ΔV % | Δ $P_o$ % |
|---|---|
| -10 | -7 |
| 0 | 0 |
| +10 | +5 |
FIG.4
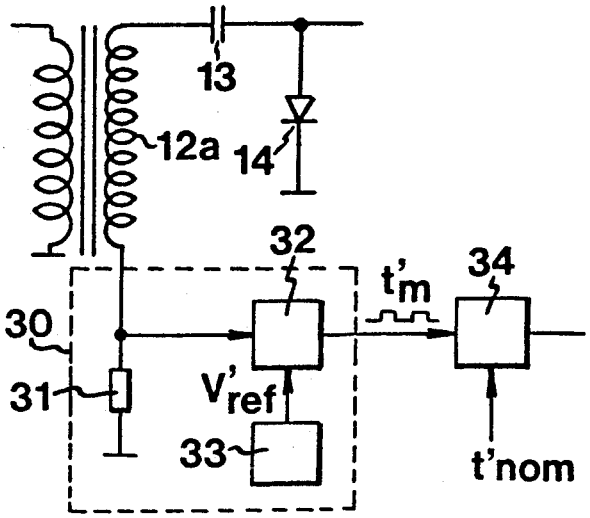

METHOD FOR CONTROLLING THE MICROWAVE ENERGY IN A MICROWAVE OVEN, AND MICROWAVE OVEN FOR IMPLEMENTING THE METHOD

The invention relates to a method for controlling the microwave energy fed by a microwave radiation source, such as a magnetron, to the chamber of a microwave oven, the microwave radiation source being driven by a power-supply circuit or a so-called power unit. Further, the invention concerns a microwave oven for implementing the method.

A common power unit for driving a magnetron essentially consists of a transformer and a capacitor, the latter forming a series resonant circuit together with the secondary winding of the transformer. However, such a power unit only permits that the magnetron is driven either with full output when the power unit emits operating voltage, or with zero output. In order to adjust the average power supplied to the chamber during a cooking procedure, the magnetron is usually pulsed, i.e. periodically switched between its two states and maintained switched on or activated so as to emit full output during a switch-on interval of a work period, and maintained switched off so as to emit zero output during the remainder of the work period. The average output is then determined by the duration of the switch-on interval in relation to the entire work period, and the quantity of energy supplied to the chamber during a cooking procedure is determined by the total amount of time the magnetron is switched on during cooking. If the magnetron is not pulsed, the switch-on time thus equals the cooking time.

All recipes and cookery-books for dishes to be cooked in a microwave oven state approximate cooking times for a certain amount of food. These cooking times are based on the fact that the magnetron when switched on or activated emits a given, known output assumed to equal the nominal output, typically 750 W. However, the actual output emitted by the magnetron depends on various fixed apparatus parameters and non-controllable operation parameters, and may thus differ from the nominal output. Under unfavourable conditions, the actual output may differ by 10% or more from the nominal output. If the actual output emitted by the magnetron is much lower than the nominal output, a sensitive food, e.g. chicken, may not be given the desired total quantity of energy during cooking and thus may not reach the final temperature required for killing the bacteria. If, on the other hand, the actual output is too high, the food may be burnt at the edges.

More specifically, the invention concerns a method of the type described in the introduction to this specification for controlling the microwave energy fed by a microwave radiation source, such as a magnetron, to the chamber of a microwave oven during cooking, wherein the microwave radiation source is switched, by connecting and disconnecting a power-supply circuit, between zero output and full output which is determined by the existing operation and apparatus parameters in the microwave radiation source of the oven, the power-supply circuit and the oven chamber, the microwave radiation source being, during a cooking procedure, either switched on with full output during the entire cooking time or pulsed with a given periodicity between full output and zero output in order to give a desired average output lower than full output, the cooking time and the output level being set at values giving a total switch-on time for the microwave radiation source during the cooking procedure that is adapted to the food introduced into the oven chamber.

The object of the invention is to control such a cooking procedure in which the microwave radiation source can only be switched between full output and zero output in such a manner that the heating result is essentially independent of variations of different operation parameters.

According to the invention, this object is achieved by measuring at least one of said parameters and comparing it (them) with a reference value which is related to the nominal value of the parameter; and using the result of the comparison to generate an effective switch-on time for the microwave radiation source that is modified in relation to the set total switch-on time when there is a difference between the nominal parameter value and the measured value, thereby substantially eliminating the effect of this difference on the microwave energy supplied during the cooking procedure.

It should be observed that SE 8803663-7 previously has suggested measuring an operation parameter, more precisely the current through the magnetron, and allowing the measured parameter to affect the power unit driving the magnetron. In this case, however, the power unit is of a completely different type, more precisely a so-called switch mode unit. Such power units have the advantage that the instantaneous output of the magnetron is easily controlled by varying the switching frequency in the unit. According to the SE patent specification, the magnetron current is measured by means of a current transformer, and the measured current is allowed to affect the switch frequency in order to form a closed control loop in which the magnetron current, and consequently the magnetron output, is maintained essentially constant. Such effective control of the output of the magnetron in a closed control loop thus implies that use is made of a power unit in which the output easily is continuously controlled, as in the switch mode unit described. The present invention solves in a simple manner the problem of varying the magnetron output caused by varying operation parameters in the much simpler and less expensive oven structure in which the power unit is simply switched on and off.

If the microwave radiation source is pulsed during the cooking procedure, in which case it is switched on during a switch-on interval of a work period and switched off during the remainder of the work period in order to yield a desired average output lower than the maximum output, the result of the comparison may, in accordance with an embodiment of the invention, be used for modifying the set duration of each switch-on interval. This has the advantage that the actual power fed to the chamber during the cooking procedure, i.e. the average power of the pulses emitted by the microwave radiation source, will be more in keeping with the set power level than if the pulse duration were maintained and the total cooking time corrected instead. This makes it possible e.g. to prevent that a food unable to withstand strong heating is exposed to too high a microwave power during the cooking procedure.

Alternatively, the invention makes it possible to use the result of the comparison between the measured and the nominal parameter value to modify the set cooking time. If the set power is lower than the maximum power, and if the microwave radiation source thus is pulsed, additional microwave pulses are emitted at the end of the set cooking time. If the set power equals the maximum power, and the microwave radiation source thus is continuously driven, the cooking time is the only control quantity available for adjusting the supplied amount of energy.

Also, both the cooking time and the duration of each switch-on interval can be modified in relation to the set values.

Conveniently, the measuring of an operation parameter and the modification or correction of the set cooking time and/or the set power level (the duration of the switch-on interval) in a pulsed microwave radiation source are continuously performed during the cooking procedure. Thus, variations in the parameter concerned during heating are corrected. For the mains voltage, which usually drives the power-supply circuit of the microwave radiation source, there is, however, an additional possibility. Normally, the mains voltage varies extremely slowly, and can in addition be measured regardless of whether the microwave radiation source is switched on or not. In one embodiment of the invention, the mains voltage is measured during a special measuring interval before starting up the oven, and the result of the comparison between the measured and the nominal value of the mains voltage is used for modifying the set switch-on time for the microwave radiation source already when the oven is started up. This is of special importance when the total cooking time is modified or corrected as a function of the measured mains voltage, since the time indicator serving to indicate the remaining cooking time can then be set at the corrected value already when the oven is started up. If measuring and correction were performed during the cooking procedure, the indicator showing the remaining cooking time might begin to go in the 'wrong' direction, thus confusing the user.

The described instantaneous modification or correction of the switch-on time performed when starting up the oven may also be combined with further continuous correction during the cooking procedure, such that an operation parameter is measured also after the oven has been started up. In such a case, the measured parameter may be any one of the parameters concerned, e.g. the magnetron current.

In a microprocessor-controlled procedure, the measured and the nominal parameter value are conveniently compared by using the measured parameter value as a pointer in a correction table with correction factors in order to correct the set switch-on time.

The microwave oven for implementing the method according to the invention comprises a chamber, a microwave radiation source, such as a magnetron, for feeding microwave energy to said chamber, a power-supply circuit for emitting operating voltage to the microwave radiation source, connecting and disconnecting means acting on the power-supply circuit for switching the microwave radiation source between an inactive state with zero output and an active state with full output which is determined by operation and apparatus parameters existing in the oven, and a timing circuit having time and output setting means for determining a cooking time and an output level during the cooking time by switching on and off the microwave radiation source, the cooking time and the output level being adapted to a food introduced into the oven chamber, and the supplied microwave energy being determined by the set total switch-on time of the microwave radiation source during the cooking procedure; characterised in that it further comprises means for measuring at least one of said parameters, and means for comparing the measured parameter value with a reference value related to the nominal value of the parameter at issue, and that, in the event of a difference between the measured and the nominal parameter value, the set switch-on time of the microwave radiation source is modified in accordance with a given relationship between the parameter value at issue and the output from the microwave radiation source, thereby substantially eliminating the effect of this difference on the microwave energy supplied during the cooking procedure.

Since the power unit in this case merely can be switched on and off, the supplied quantity of energy can only be adjusted by altering the duration of the total cooking time or the duration of each switch-on interval. This means that adjustment has to take place in an open control loop, since the result of the adjustment, the correction of time, cannot be returned as a control quantity for controlling the procedure. Thus, the adjustment has to be performed according to a known relationship between a difference in each parameter value and the resulting difference in output from the microwave radiation source. Thus, the invention encompasses accurately determining this relationship for each parameter and programming the comparing means accordingly, e.g. in the form of a table indicating the difference in output for each difference in the parameter value.

When a magnetron is employed as microwave radiation source, the measuring means in one embodiment of the microwave oven according to the invention may comprise a device measuring the current through the magnetron. This current is directly representative of the instantaneous output of the magnetron, and thus especially suited for monitoring, provided that it is possible to accurately measure this current which essentially is a pulsed direct current of a particular curve shape.

SE 8803663-7 discloses how to employ a current transformer for measuring the current through the magnetron. This is possible since the alternating current component in the special current curve shape in this case is an adequate measure of the direct current content. In a more simple method for measuring the magnetron current, applicable to the present case, the current-measuring device is a circuit comparing the instantaneous value of the magnetron current with a reference value, the duration of the time interval during which the magnetron current exceeds the reference level being measured. This duration is an adequate measure of the resulting direct current and is easily rendered in digital form.

Alternatively, a current transformer can be used for measuring the magnetron current also in the present case.

In another embodiment of the oven according to the invention, the measuring means comprise a device measuring the mains voltage. Variations in the mains voltage primarily affect the magnetron current, but also have a considerable effect on the starting-up time for the magnetron required every time it is switched on, i.e. the time elapsing between initiation of switching on and actual switching on. This variation in the starting-up time may be of considerable importance in pulsed driving of the magnetron.

Also the mains voltage can be measured by comparing the instantaneous voltage with a reference level and determining the duration of the time interval during which the mains voltage exceeds the reference level.

The magnetron output is at a maximum when the magnetron is cold, and diminishes as the magnetron approaches operating temperature. To compensate for this, the measuring means in the oven according to the invention may comprise a sensor measuring the magnetron temperature. Such measuring of the temperature can be combined with measuring of the magnetron current and the mains voltage, but might solely in combination with measuring of the mains voltage replace measuring of the magnetron current.

Ventilation of the oven chamber has a cooling effect on the food being heated. The warmer the cooling air, the less energy is required during cooking to attain a desired final temperature. In one embodiment of the oven according to the invention, the measuring means therefore may also comprise a sensor for measuring the temperature in the oven chamber.

Figure 6:
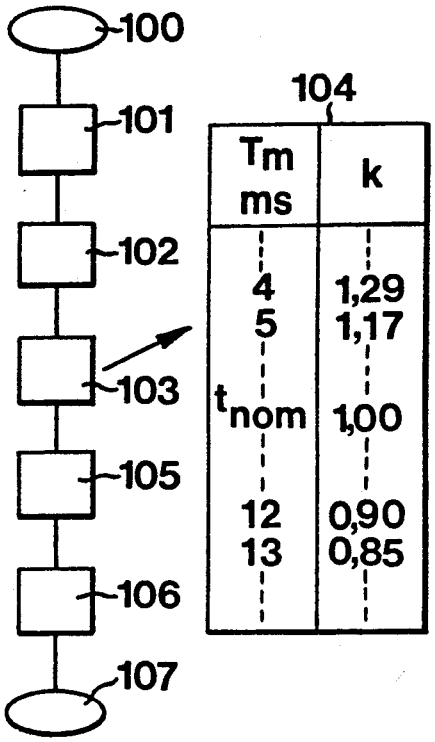
Figure 8:
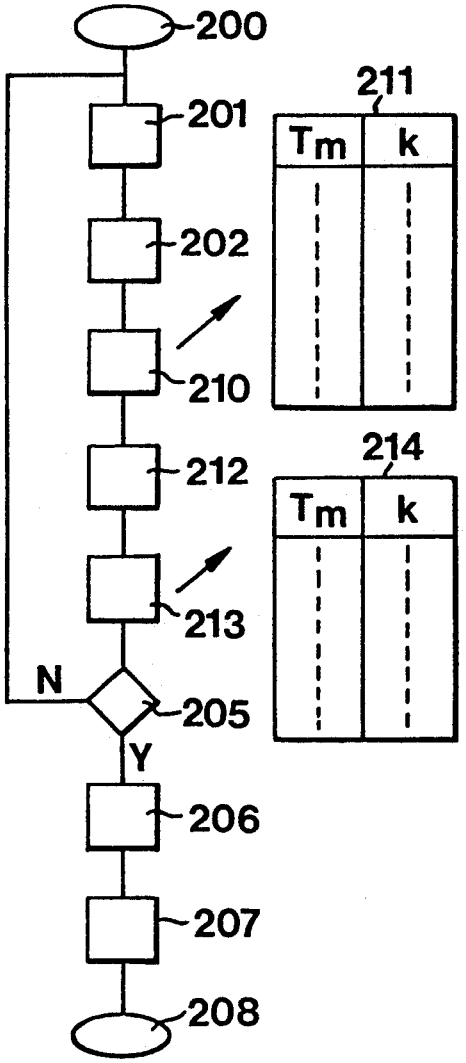
Figure 7:
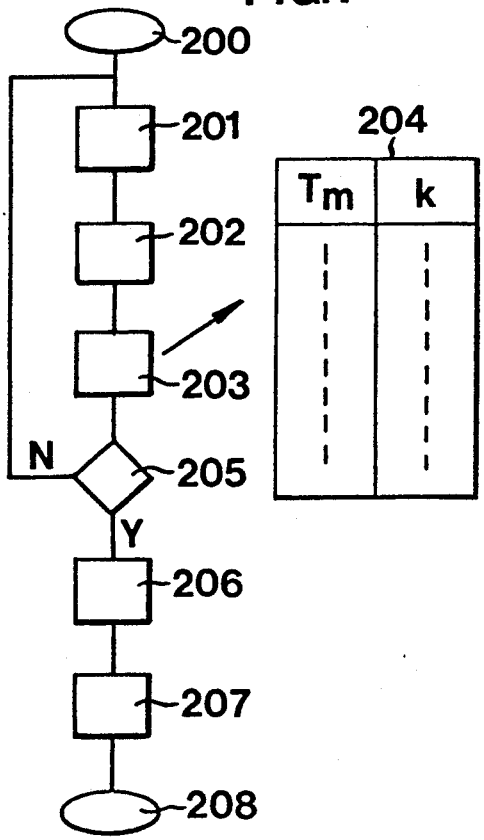

The invention will now be illustrated in more detail with the aid of Examples referring to the accompanying drawings, in which FIG. 1 is a circuit diagram, partly a block diagram, of a microwave oven in which the microwave energy is controlled by measuring the mains voltage, FIG. 2 is a time diagram illustrating how the measured mains voltage of FIG. 1 is converted to a pulse duration that can be measured by a microprocessor, FIG. 3 is a table illustrating the difference in magnetron output for different variations in mains voltage, FIG. 4 illustrates a measuring circuit for measuring the magnetron current and converting the measured value to a pulse duration, FIG. 5 illustrates a measuring circuit comprising a temperature sensor for measuring the magnetron temperature or the temperature in the oven chamber, FIG. 6 is a flow diagram illustrating an embodiment of the invention in which a microprocessor is used for controlling primarily the pulse duration of the magnetron (the switch-on interval) as a function of a measured parameter, such as the mains voltage, FIG. 7 is a corresponding flow diagram illustrating an embodiment comprising a microprocessor for controlling primarily the total cooking time, the mains voltage being measured during a special measuring interval before the cooking procedure, and FIG. 8 is a flow diagram, similar to that of FIG. 7, illustrating an embodiment in which the microwave energy is controlled by altering both the pulse duration of the magnetron and the total cooking time.

FIG. 1 shows a power unit 10 which is driven by a mains voltage V and emits operating voltage to a magnetron 11. The power unit, which is of conventional type, essentially comprises a transformer 12, a capacitor 13, and a diode 14. A secondary winding 12*a* of the transformer emits, via the capacitor 13 and the diode 14, rectified high-voltage pulses to the magnetron, and another secondary winding 12*b* emits heater current to the thermionic cathode of the magnetron. The power unit further includes a switch means 15, e.g. a triac or a relay. By means of the switch means 15, the magnetron is switched between full output and zero output. The switch is controlled by a timer 16 via a control input 15*a*. The times indicated by the timer are determined by a time and output setting device 17 which includes, in conventional manner, setting means for primarily determining a total cooking time T. There are further provided setting means for determining a desired power level P during the cooking procedure. If the set power level is at a maximum, the magnetron may be switched on to emit full output during the total cooking time. If the set power level is below maximum, the magnetron is pulsed, i.e. periodically switched between full output and zero output, and the relationship between the switch-on interval and the switch-off interval of each work period determines the average output obtained. Each set power level will then correspond to a given duration of the switch-on interval.

In the power unit shown, the capacitor forms a series resonant circuit with the secondary winding of the transformer. This circuit supplies to the magnetron an operating current which is influenced by various fixed apparatus parameters, such as the capacitance of the capacitor and the inductance in the secondary winding of the transformer, but also by a number of variable operation parameters, such as the mains voltage, the magnetron current, the magnetron temperature and the temperature in the oven chamber. Among these parameters, the mains voltage is a main parameter, since it directly affects the magnetron current and, consequently, the output. Since the mains-voltage-operated power unit emitting operating voltage to the magnetron also supplies heater current to the thermionic cathode of the magnetron, an alteration of the mains voltage will affect the time it takes to heat the cathode and, consequently, to start up the magnetron, i.e. the time elapsing between initiation of start-up and actual start-up. The variation in start-up time may have a considerable effect on the average output when the magnetron is pulsed and the power level is low. SE 8800323-1 discloses how to compensate for the average output error caused by variations in start-up time by sensing the actual time of start-up.

In the embodiment of a microwave oven according to the invention shown in FIG. 1, the mains voltage is measured by a voltage-measuring device 20 which here is made up of a threshold circuit 21 and a source 22 emitting a reference voltage $V_{ref}$. In the threshold circuit 21, the mains voltage V is compared with the reference voltage $V_{ref}$, and an output voltage from the circuit is obtained during the interval when the mains voltage exceeds the reference voltage. In FIG. 2, the upper curve a) illustrates the mains voltage V as a function of time t, and the lower curve b) illustrates the output voltage $V_m$ from the threshold circuit. This output signal is a pulse signal in which the duration $t_m$ of the pulses depends on the chosen reference voltage and the amplitude of the mains voltage. Thus, the pulse duration $t_m$ is the quantity representing the amplitude of the mains voltage on the occasion of measuring. The pulse signal $V_m$ containing the measured quantity $t_m$ is transmitted to a comparing element 23 where the quantity $t_m$ is compared with a nominal value $t_{nom}$ identical with the value of $t_m$ when the mains voltage equals the nominal value. The result of this comparison made in the comparing element 23 is allowed to affect the timer, such that the actual times emitted by the timer differ from the set times when $t_m$ differs from $t_{nom}$. The alteration or correction of the set times is made according to a given, carefully determined function representing the relationship between the magnetron output and the mains voltage. Such a relationship is illustrated in FIG. 3, where the left-hand column states the difference $\Delta V$ between the mains voltage and the nominal value, and the right-hand column states the ensuing difference $\Delta P_o$ in magnetron output. The correction performed by the comparing circuit of the times set in the timer is now implemented in such a manner that the total switch-on time for the magnetron during a cooking procedure (i.e. the total cooking time when the magnetron operates continuously, and the sum of the switch-on intervals when the magnetron is pulsed) is altered in accordance with the right-hand column in FIG. 3 but with opposite signs at mains voltage variations according to the left-hand column. Thus, the effect of variations in mains voltage on the total quantity of energy supplied during a cooking procedure is eliminated. The mains voltage may be measured both during an interval before starting up the oven and during the cooking procedure itself.

FIG. 4 illustrates a simple measuring circuit 30 for measuring the magnetron current which is a direct measure of the instantaneous output. The magnetron current can only be measured during the cooking procedure. As shown in FIG. 4, the measuring circuit 30 is made up of a small measuring resistor 31 connected in series to the secondary winding 12*a* of the transformer 12, a threshold circuit 32 and a source 33 for a reference voltage $V'_{ref}$. To the threshold circuit 32 are supplied the voltage across the resistor 31 and the reference voltage $V'_{ref}$, and the threshold circuit 32 emits, in the manner of the threshold circuit 21 of FIG. 1, an output pulse when the measured voltage exceeds the reference voltage. The duration $t'_m$ of the output pulses from the threshold circuit 32 then indicates the magnetron current. The output pulses from the circuit 32 are fed to a comparator circuit 34, where the pulse duration $t'_m$ is compared with the nominal value $t'_{nom}$, i.e. the duration the measured pulse would have if the magnetron current had nominal value. The result of the comparison made in the circuit 34 is used in the manner described earlier for correcting the actual times emitted by the timer in relation to the set times in accordance with a predetermined relationship between the difference in output and the difference in the measured quantity $t'_m$ representing the magnetron current.

FIG. 5 illustrates a measuring circuit 40 for measuring the magnetron temperature or the temperature in the oven chamber. As shown, the measuring circuit 40 is made up of a semiconductor sensor or thermistor 41, a stabilised voltage source 42, a linearisation network consisting of the resistors 43, 44, and an analog-to-digital converter 45. The voltage source 42 transmits a current through the linearisation network 43, 44, where the thermistor 41 is connected as a parallel resistor with respect to the resistor 44. Thus, the voltage at the connecting point O is dependent on the value of the thermistor and, consequently, on the sensed temperature. The voltage at the point O is digitalised in the converter 45, and the converter 45 transmits a signal containing binary numbers $n_T$ representing the instantaneous temperature of the magnetron or the oven chamber. These binary numbers are sent to the comparing element 46, where they are compared with a number $n_{nom}$ representing a nominal value of the parameter at issue. The set times are then corrected in the manner described above.

FIG. 6 is a flow diagram illustrating a microprocessor-controlled embodiment of the microwave oven according to the invention, in which the supplied quantity of energy is adjusted by correcting the switch-on interval of the magnetron (the duration of the magnetron pulses) when the magnetron is pulsed. The chosen parameter may in this case be measured repeatedly during the cooking procedure, and any parameter may be measured.

The procedure is started in block 100. In block 101, the chosen parameter is measured, e.g. the pulse duration $t_m$ of the mains voltage is determined. In block 102, the average value $T_m$ of the ten latest measured values is determined, and is then used in block 103 as a pointer (address) in a correction table 104 indicated to the right of block 103 in FIG. 6. The correction table has a column for the measured quantity, i.e. the average value $T_m$, and a column for the correction factor k of each measured value. The nominal value $t_{nom}$ is, in the correction table, stored opposite to the correction factor 1.00. Every time an average value of the measured values is established, this value is employed as an address in the correction table, and the corresponding correction factor is read from the table. Block 103 with the correction table 104 corresponds to the comparing circuit where the measured value is compared with the nominal value in the preceding embodiments. In block 105, the set magnetron pulse duration is multiplied by the read correction factor, and in block 106, the new and corrected time is used for resetting the timer. The procedure is completed in block 107.

FIG. 7 is a flow diagram illustrating a microprocessor-controlled embodiment of the oven according to the invention, in which the mains voltage is measured during a special measuring interval before the oven is started up, and the supplied quantity of energy is adjusted by correcting the total cooking time. In block 200 (FIG. 7), measuring of the mains voltage is begun. In blocks 201 and 202, measuring and average-value formation are performed in the manner described earlier, and in block 203, the resulting average value is used as a pointer for obtaining a correction factor from a correction table 204. At this stage, the microprocessor has stored, on a special memory location, a correction factor that may be updated as measuring proceeds. Box 205 puts the question 'has heating begun?'. If 'no', measuring of the mains voltage continues to give an increasingly better value of the correction factor. If 'yes', the last read and stored correction factor is retrieved and, in block 206, multiplied by the set cooking time. In block 207, the new and corrected cooking time is then used for resetting the timer, and the procedure is completed in block 208. In this case, the set cooking time is thus corrected instantaneously already when the oven is started up.

FIG. 8 is a flow diagram similar to that of FIG. 7. In this case, however, the supplied quantity of energy is adjusted by correcting the pulse duration of the magnetron when pulsed, as well as the total cooking time. The mains voltage is assumed to be measured during a special measuring interval before the magnetron is actuated. Measuring start-up, measuring and average-value formation take place in blocks 200, 201 and 202, as before. In block 210, the obtained average value is used as a pointer in a correction table 211, and in block 212, the set pulse duration of the magnetron (the set magnetron average output) is multiplied by the correction factor read from the table 211. The average value obtained in block 202 is also used in block 213 as a pointer in another correction table 214 for reading and storing another correction factor. At this stage, there is thus a corrected pulse duration for the magnetron and a correction factor (for the cooking time). As before, block 205 puts the question 'has heating begun?'. If 'no', measuring will continue. If 'yes', the read correction factor is multiplied by the set cooking time in block 206. The new cooking time is used or stored in block 207, and the procedure is completed in block 208.

In the Example illustrated in FIG. 8, the pulse duration of the magnetron is thus corrected by means of a correction factor read from the table 211, and the total cooking time is corrected by means of a correction factor read from the table 214. The two tables 211 and 214 are so drawn up that the two correction factors together result in the desired correction of the quantity of energy supplied during the cooking procedure, i.e. the same correction achieved by solely the correction factor read from the table 204 in FIG. 7.

An advantageous variant of this Example employing two-step correction consists in measuring the mains voltage during a special measuring interval before starting up the oven, and making the best possible correction of the set cooking time with the aid of the value measured when starting up the oven. Since mains-voltage variation is a primary cause for varying magnetron output, the main part of the correction required is already performed at start-up. However, instead of completing the procedure when starting up the oven, measuring may continue and minor corrections be performed during the cooking procedure, such corrections being sometime required owing to varying operation circumstances during the cooking procedure. Instead of measuring the mains voltage, one may measure a parameter which even better indicates the magnetron output and the required correction, e.g. the magnetron current, optionally in combination with measuring the temperature of the magnetron and the oven chamber. If the magnetron is pulsed, it may be suitable to correct the pulse duration of the magnetron, instead of the cooking time, by means of the measuring results obtained during the cooking procedure.

We claim:

1. A method of controlling the microwave energy fed by a magnetron to an oven chamber of a microwave oven during a cooking procedure, wherein the magnetron is switched, by connecting and disconnecting a power-supply circuit, between zero output and full output which is determined by one of an nominal existing operation and apparatus parameter in the magnetron, a power-supply circuit for said magnetron and said oven chamber, the magnetron being, during a cooking procedure, either switched on with full output during the entire cooking time or pulsed with a given periodicity between full output and zero output in order to give a desired average output lower than full output, the cooking time and the output level being set at values giving a total switch-on time for the magnetron during the cooking procedure that is adapted to the food introduced into the oven chamber, said method comprising measuring at least one of said parameters and comparing it with a reference value which is related to the nominal value of the parameter; and using the result of the comparison to generate an effective switch-on time for the magnetron that is modified in relation to a set total switch-on time when there is a difference between the nominal parameter value and the measured value, thereby substantially eliminating the effect of this difference on the microwave energy supplied during the cooking procedure.

2. A method as claimed in claim 1, wherein the magnetron is pulsed during the cooking procedure which thus is divided into a number of work periods, the magnetron being switched on during a switch-on interval of a work period and switched off during the remainder of the work period in order to give a desired average output, wherein the result of the comparison is utilized to modify the duration, set by a chosen output level, of each switch-on interval.

3. A method as claimed in claim 2, wherein the result of the comparison is utilized to modify the set cooking time.

4. A method as claimed in claim 3, wherein the result of the comparison is utilized to modify both the cooking time and the duration of each switch-on interval in relation to the set values.

5. A method as claimed in claim 1, wherein a power-supply circuit is driven by mains voltage, wherein the mains voltage is measured during a special measuring interval before starting up the oven; and the result of the comparison between the measured and the nominal value of the mains voltage is utilized to modify the set switch-on time of the microwave radiation source when starting the cooking procedure of the oven.

6. A method as claimed in claim 5, wherein a microprocessor is used for controlling the procedure, wherein the comparison between the measured and the nominal parameter value is made by using the measured parameter value as a pointer in a correction table with correction factors in order to correct the set switch-on time.

7. A microwave oven comprising a chamber, a microwave radiation source for feeding microwave energy to said chamber, a power-supply circuit for emitting operating voltage to the microwave radiation source, connecting and disconnecting means acting on the power-supply circuit for switching the microwave radiation source between an inactive state with zero output and an active state with full output, operation and apparatus parameters existing in the oven as a result of operation of said oven, and a timing circuit having time and output setting means for determining a cooking time and an output level during the cooking time by switching on and off the microwave radiation source, the cooking time and the output level being adapted to the food introduced into the oven chamber, and the supplied microwave energy being determined by the set total switch-on time of the microwave radiation source during the cooking procedure, means for measuring at least one of said parameters, and means for comparing the measured parameter value with a reference value related to a chosen nominal value of the parameter at issue, and that, in the event of a difference between the measured and the nominal parameter value, the set switch-on time of the microwave radiation source is modified in accordance with a given relationship between the parameter value at issue and the output from the microwave radiation source, thereby substantially eliminating the effect of this difference on the microwave energy supplied during the cooking procedure.

8. A microwave oven as claimed in claim 7, wherein a magnetron is used as microwave radiation source, and the measuring means comprise a device measuring the current through the magnetron.

9. A microwave oven as claimed in claim 8, wherein the current-measuring device is designed to measure the duration of the time interval during which the magnetron current exceeds a reference current level.

10. A microwave oven as claimed in claim 9, wherein a power-supply circuit is driven by the mains voltage, and the measuring means comprises a device measuring the mains voltage.

11. A microwave oven as claimed in claim 10, wherein the foltage-measuring device is designed to measure the duration of the time interval during which the mains voltage exceeds a reference voltage level.

12. A microwave oven as claimed in claim 7, wherein the measuring means comprises a sensor adapted to sense the temperature of the magnetron.

13. A microwave oven as claimed in claim 7, the measuring means comprises a sensor adapted to sense the temperature in the oven chamber.

* * * * *